US006584981B2

(12) United States Patent
Hampl, Jr.

(10) Patent No.: US 6,584,981 B2
(45) Date of Patent: Jul. 1, 2003

(54) CIGARETTE PAPER CONTAINING CARBON FIBERS FOR IMPROVED ASH CHARACTERISTICS

(75) Inventor: Vladimir Hampl, Jr., Roswell, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 10/008,555

(22) Filed: Nov. 13, 2001

(65) Prior Publication Data

US 2002/0069888 A1 Jun. 13, 2002

Related U.S. Application Data

(62) Division of application No. 09/396,956, filed on Sep. 15, 1999, now Pat. No. 6,314,964.

(51) Int. Cl.[7] ..... A24D 1/02

(52) U.S. Cl. ..... 131/365; 131/331; 131/360; 162/139; 162/138; 162/146; 162/145

(58) Field of Search ..... 131/331, 365, 131/360; 162/139, 176, 158, 145, 146, 138

(56) References Cited

U.S. PATENT DOCUMENTS

| | | | | |
|---|---|---|---|---|
| 3,744,496 | A | | 7/1973 | McCarty et al. |
| 4,225,636 | A | | 9/1980 | Cline et al. |
| 4,505,282 | A | | 3/1985 | Cogbill et al. |
| 4,938,238 | A | * | 7/1990 | Barnes et al. ..... 131/365 |
| 5,105,835 | A | | 4/1992 | Drewett et al. |
| 5,107,864 | A | | 4/1992 | Owens, Jr. |
| 5,144,967 | A | | 9/1992 | Cartwright et al. |
| 5,172,708 | A | | 12/1992 | Drewett et al. |
| 5,228,464 | A | | 7/1993 | Owens, Jr. |
| 5,253,660 | A | | 10/1993 | Dixit et al. |
| 5,271,419 | A | | 12/1993 | Arzonico et al. |
| 5,307,823 | A | | 5/1994 | Jones et al. |
| 5,327,916 | A | | 7/1994 | Jones et al. |
| 5,360,023 | A | | 11/1994 | Blakley et al. |
| 5,385,158 | A | | 1/1995 | Owens, Jr. |
| 5,404,890 | A | | 4/1995 | Gentry et al. |
| 5,730,840 | A | | 3/1998 | Hampl et al. |

FOREIGN PATENT DOCUMENTS

| | | |
|---|---|---|
| AU | 135218 | 11/1949 |
| EP | 0533423 A1 | 3/1993 |
| JP | 299699 | 10/1988 |

OTHER PUBLICATIONS

European Search Report EP 00 11 9808 Jan. 19, 2001.

* cited by examiner

*Primary Examiner*—Steven P. Griffin
*Assistant Examiner*—M. Halpern
(74) *Attorney, Agent, or Firm*—Dority & Manning, P.A.

(57) ABSTRACT

The present invention is directed to a method for improving the ash characteristics of a paper wrapper for a smoking article and for improving the ash characteristics of the smoking article itself. Specifically, it has been unexpectedly discovered that the ash cohesiveness of a paper wrapper is noticeably improved when carbon fibers having an average length less than about 0.75 inches are incorporated into the paper in an amount up to about 60% by weight. Paper wrappers made with carbon fibers in accordance with the present invention have superior ash characteristics in comparison to paper wrappers incorporating only flax or other cellulosic fibers. Further, the ash cohesiveness of the paper is improved without resulting in the decline in the quality of other ash characteristics.

20 Claims, No Drawings

CIGARETTE PAPER CONTAINING CARBON FIBERS FOR IMPROVED ASH CHARACTERISTICS

RELATED APPLICATIONS

This patent application is a division of U.S. patent application Ser. No 09/396,956 filed Sep. 15, 1999, which issued as U.S. Pat. No. 6,314,964 on Nov. 13, 2001.

FIELD OF THE INVENTION

The present invention is generally directed to a method for improving the ash characteristics of a paper used to construct smoking articles. More particularly, the present invention is directed to a process for improving the ash cohesiveness of cigarette paper by incorporating carbon fibers into the paper sheet.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and contain a filler, such as calcium carbonate.

Besides being used to hold the cigarette together, cigarette wrapping papers and tipping papers also contribute to and control many physical properties and characteristics of the cigarette. For instance, cigarette wrapping paper affects the rate at which the cigarette burns, i.e. the number of puffs per cigarette and the total tar delivery per puff. Another property of the cigarette that is affected by the wrapper is the appearance and cohesiveness of the ash that is formed as the cigarette burns. Ideally, cigarette ash should be cohesive, should not flake off from the cigarette, and should have an aesthetically pleasing appearance.

The quality of cigarette ash is generally determined by rating the ash according to four criteria. The first criterion is ash color. In general, a whiter ash has a more aesthetic appearance and is thus more desirable. The second criterion is ash cohesiveness and the ability of the ash to avoid excessive flaking. The ash should not flake off the cigarette unless the cigarette is flicked or tapped on an object. Further, once the cigarette is tapped, the ash should break off in clumps and not disintegrate.

The last two criteria used to evaluate cigarette ash are dependant for the most part upon the cigarette wrapping paper and not upon the ash characteristics of the tobacco column. For example, the third criterion for evaluating cigarette ash is the thickness of the char line appearing on the wrapper as a cigarette is burned. Thinner char lines are preferred. Finally, the last criterion is the extent to which the cigarette wrapper stains downstream (towards the filter) from the ash as the cigarette is smoked. A high quality wrapping paper will not stain or discolor throughout the length of the cigarette as the cigarette is puffed.

In the past, various methods have been devised in order to improve the ash characteristics of a smoking article. For instance, previous efforts for improving the appearance of ash have included changing the type of cellulosic fiber used to make the cigarette wrapping paper. Also, ash modifiers have been added to the paper or to the tobacco. In particular, it has been proposed in the past to add to the paper starches or salts to improve ash characteristics without adversely affecting the qualities of the paper. Unfortunately, the use of conventional cellulosic fibers and ash modifiers does not provide sufficient ash cohesiveness such that the ash does not flake off too easily.

Thus, a need exists for a method of improving cigarette ash characteristics without detrimentally affecting the other properties of the cigarette. In particular, a need exists for a method that improves the ash cohesiveness of a cigarette wrapping paper without adversely affecting the appearance of the ash or the permeability of the paper, the taste, the burn rate, the puff count, or the tar delivery per puff of a cigarette incorporating the paper.

SUMMARY OF THE INVENTION

The present invention recognizes and addresses various disadvantages of prior art constructions and methods. Accordingly, it is an object of the present invention to provide a method for improving the ash characteristics of a cigarette paper and of a cigarette incorporating the paper.

It is another object of the present invention to provide a method for improving the ash cohesiveness of a cigarette paper without adversely affecting other cigarette ash characteristics.

Still another object of the present invention is to provide a method for improving the ash cohesiveness of a cigarette paper by incorporating into the paper carbon fibers.

Another object of the present invention is to provide a method for improving the ash cohesiveness of a cigarette paper by incorporating into the paper carbon fibers having an average length less than about 0.75 inches.

It is another object of the present invention is to provide a method for improving the ash cohesiveness of a cigarette paper by incorporating into the paper carbon fibers having an average length less about 0.75 inches and added in an amount less than about 60% by weight.

These and other objects of the present invention are achieved by providing a process for improving the ash characteristics of a paper wrapper for a smoking article. The process includes the step of incorporating carbon fibers into a paper wrapper. The carbon fibers have an average length less than about 0.75 inches, particularly from about 0.125 inches to about 0.5 inches, and more particularly about 0.25 inches. The carbon fibers can be added to the, paper wrapper in an amount from less than about 60% by weight, and more particularly from about 5% to about 20% by weight.

According to the present invention, the paper wrapper can have a basis weight from about 18 gsm to about 60 gsm, but typically is from about 45 gsm to about to 55 gsm in one embodiment and from about 22 gsm to about 32 gsm in an alternative embodiment. The paper wrapper can have a permeability of from about 5 Coresta units to about 2000 Coresta units, particularly from about 5 Coresta units to about 80 Coresta units.

In one embodiment, a filler can be coated onto the paper wrapper or incorporated into the paper wrapper. The filler, for instance, can be a calcium carbonate. For example, calcium carbonate filler can be added in an amount of from about 20% by weight to about 40% by weight. The paper wrapper can also be coated with a burn control additive. The burn control additive, for instance, can be an alkali metal salt, an acetate, a phosphate salt, or mixtures thereof. For example, the burn control additive can be a citrate and can be added to the paper in an amount from about 0.3% to about 12% by weight.

In still another embodiment, a viscosity modifier can be incorporated into the paper. For instance, the viscosity modifier can be an alginate. This makes it easier to process the carbon fibers in the slurry. A better formation is obtained.

Other objects, features and aspects of the present invention are discussed in greater detail below.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention which broader aspects are embodied in the exemplary construction.

The present invention is generally directed to a method for improving the ash characteristics of a wrapping paper and for improving the ash characteristics of a smoking article incorporating the wrapping paper. Specifically, the characteristic of ash cohesiveness is improved by adding to the paper carbon fibers having an average length less than about 0.75 inches, and more particularly between about 0.125 inches to about 0.50 inches. The carbon fibers are generally added to the wrapping paper at an amount up to about 60% by weight, and more particularly between about 5% to about 20% by weight. Further, the ash cohesiveness of the paper is improved without significantly harming other ash characteristics or qualities of the wrapping paper.

Paper wrappers for smoking articles made in accordance with the present invention exhibit an ash that is significantly more cohesive than many prior art constructions containing only flax or other cellulosic fibers in the paper sheet. When traditional paper wrappers burn, the organic matters, i.e. flax and other cellulosic fibers within the paper, tend to burn and flake off. However, by incorporating carbon fibers into the paper wrapper in accordance with the present invention, a cohesive ash can form. As a paper wrapper incorporated with carbon fibers burns, the carbon fibers form a matrix-like structure that is substantially free from flaking, thus producing a cohesive ash.

The construction of a cigarette wrapping paper made in accordance with the present invention will now be discussed in greater detail.

In addition to carbon fibers, the wrapping paper can also include cellulosic fibers obtained, for instance, from flax, softwood or hardwood. The flax or other cellulosic fibers are generally added in an amount of about 15% to about 99% by weight, and more particularly from about 50% to about 65% by weight.

Moreover, the wrapping paper can also include a filler, such as calcium carbonate or other white pigments such as magnesium or titanium oxides, to further enhance the characteristics of the wrapping paper. Depending on the amount of filler added to the wrapping paper, the amount of flax or other cellulosic fibers in the paper can vary substantially. For example, in a preferred embodiment of the present invention, calcium carbonate filler is added to the wrapping paper at a level of from about 20% by weight to about 40% by weight, and particularly from about 25% by weight to about 35% by weight.

At a filler level of 30% by weight, for instance, the flax or other cellulosic fibers can range from an amount between about 15% to about 69% by weight, depending on the amount of carbon fibers added to the wrapper. Preferably, when the filler is added in an amount of 30% by weight, the carbon fibers are added in amount between about 5% to about 20% by weight and the flax fibers are added in an amount between about 50% to about 65% by weight.

The permeability of a paper wrapper made according to the present invention can generally range from about 5 Coresta units to about 2000 Coresta units, depending on the type, particle size, and amount of filler present within the paper. In most applications, the permeability of a cigarette paper wrapper is between about 15 Coresta units to about 55 Coresta units. As carbon fibers are added to a paper wrapper made according to the present invention, the permeability of the paper increases, i.e. the Coresta value increases. As such, a paper wrapper incorporating relatively high amounts of carbon fibers, e.g. above about 20% by weight, can have a permeability above the Coresta value normally desired for paper wrappers. To decrease the permeability of a paper wrapper containing such high amounts of carbon fibers, the fiber furnish can simply be refined to a greater extent to decrease the Coresta value to a desired level without having to decrease the level of carbon fibers within the paper wrapper.

As stated above, various ratios of flax and carbon fibers can be used in a paper wrapper made according to the present invention. The basis weight of the paper wrapper increases as the amount of flax fibers and carbon fibers increases. Therefore, the basis weight of a paper wrapper made in accordance with the present invention can vary depending on the exact ratio of flax and carbon fibers used. Generally, the basis weight can range from about 18 grams per square meter (gsm) to about 80 grams per square meter (gsm). In particular, the basis weight is between about 20 gsm to about 55 gsm. The cigarette paper can also be treated with a burn control additive which may have a further effect on the overall basis weight of the paper wrapper. Such burn control additives can include, for instance, alkali metal salts, acetates, phosphate salts, or mixtures thereof. For example, the burn control additive can be a citrate and can be added to the paper in an amount from about 0.3% to about 12% by weight.

As described above, the present invention is directed to incorporating into a paper wrapper carbon fibers to improve the ash characteristics of the paper and to a smoking article constructed with the paper. The carbon fibers added to the paper wrapper can have an average length less than about 0.75 inches. However, because it is possible that relatively long fibers might cause entangling, it is generally preferred that the average length be between about 0.125 inches to about 0.5 inches. For example, in one embodiment, the carbon fibers have an average length of approximately 0.25 inches.

One particular commercially available carbon fiber that can be used in the present invention is TYPE 3C carbon fiber marketed by Fortafil Fibers, Inc. TYPE 3C carbon fiber has an average length of about 0.25 inches and a diameter of about 7.3 microns.

In producing paper wrappers in accordance with the present invention, the paper wrapper can be made by creating a fiber suspension of carbon fibers and flax or other cellulosic fibers. For instance, the fiber suspension can be formed from a fiber furnish that has been cooked in a digester, washed, bleached, and refined. As noted above, the amount of refinement can vary depending on the level of permeability required.

Other additives can also be added to the fiber suspension before forming the paper wrapper. For example, a filler slurry formed from water and a particular filler can be combined with the suspension. Furthermore, a viscosity modifier can also be added to the fiber suspension to aid in the processing of the cigarette paper by increasing the viscosity of the fiber suspension mixture. The viscosity modifier can be, for instance, an alginate.

To form the paper wrapper, the fiber suspension mixture can be spread out onto a screen or set of screens and dried. It is also believed that a filler can be coated onto the paper after it has been formed.

The present invention may be better understood with reference to the following example.

EXAMPLE

The ash characteristics of paper wrappers incorporating carbon fibers were examined. The carbon fibers were TYPE 3C carbon fibers marketed by Fortafil Fibers, Inc., having an average length of about 0.25 inches and a median particle diameter of 7.3 microns. The paper wrapper also incorporated ALBACAR 5970 calcium carbonate filler having a median particle size of 1.9 microns. The ALBACAR 5970 filler was obtained from Specialty Minerals, Inc. of Adams, Mass.

Cigarette wrappers were made incorporating the following mixtures of TYPE 3C carbon fibers, flax fibers, and ALBACAR 5970 filler:

TABLE I

Carbon fiber/flax fiber paper wrappers

| Carbon Fiber (wt %) | Flax Fiber (wt %) | ALBACAR 5970 (wt %) | Basis wt. ($g/m^2$) | CORESTA (cm/min) |
|---|---|---|---|---|
| 0 | 69 | 31 | 49 | 5 |
| 18 | 52 | 30 | 51 | 18 |
| 35 | 35 | 30 | 53 | 300 |
| 54 | 18 | 28 | 54 | 2000 |

Cigarettes were hand rolled from sheets comprising various ratios of fibers as listed in the above example. The cigarettes were lit and allowed to burn freely. As the cigarette burned, the formed ash was observed and evaluated.

From this example, it was discovered that cigarette ash containing carbon fibers was noticeably more cohesive than cigarette ash containing no carbon fibers. Specifically, as the cigarette burned, the carbon fibers left behind a matrix-like arrangement that was free from flakes or fissures.

These and other modifications and variations of the present invention may be practiced by those of ordinary skill in the art, without departing from the spirit and scope of the present invention, which is more particularly set forth in the appended claims. In addition, it should be understood that aspects of various embodiments may be interchanged both in whole or in part. Furthermore, those of ordinary skill in the art will appreciate that the foregoing description is by way of example only, and is not intended to limit the description so further described in such appended claims.

What is claimed is:

1. A process for improving the ash characteristics of a paper wrapper for a smoking article comprising the step of:

incorporating into a paper wrapper carbon fibers, said carbon fibers having an average length between about 0.125 inches to about 0.5 inches.

2. A process as defined in claim 1, wherein said carbon fibers have an average length between about 0.25 inches to about 0.35 inches.

3. A process as defined in claim 1, wherein said carbon fibers are incorporated into said paper wrapper in an amount less than about 60% by weight.

4. A process as defined in claim 1, wherein said carbon fibers are incorporated into said paper wrapper in an amount from about 5% to about 20% by weight.

5. A process as defined in claim 1, further comprising the step of incorporating into said paper wrapper a filler.

6. A process as defined in claim 5, wherein said filler comprises calcium carbonate.

7. A process as defined in claim 5, wherein said filler is incorporated into said paper wrapper in an amount between about 20% to about 40% by weight.

8. A process as defined in claim 5, wherein said filler comprises calcium carbonate and is incorporated into said paper wrapper in an amount between about 28% to about 32%.

9. A process as defined in claim 1, wherein said paper wrapper has a basis weight from about 45 gsm to about 60 gsm.

10. A process as defined in claim 1, wherein said paper wrapper has a permeability from about 5 Coresta units to about 2000 Coresta units.

11. A process as defined in claim 1, further comprising the step of coating said paper with a burn control additive, said burn control additive being a material selected from the group consisting of alkali metal salts, acetates, phosphate salts, and mixtures thereof.

12. A process as defined in claim 11, wherein said burn control additive comprises a citrate, said citrate being added to said paper wrapper in an amount from about 0.3% to about 12% by weight.

13. A process as defined in claim 1, wherein the paper wrapper has a permeability of from about 15 Coresta units to about 55 Coresta units.

14. A process for improving the ash characteristics of a paper wrapper for a smoking article comprising the steps of:

providing a paper wrapper comprising cellulosic fibers and a filler;

incorporating into the paper wrapper carbon fibers, the carbon fibers having a length and being present in the paper wrapper in an amount sufficient to improve the ash cohesiveness of a smoking article incorporating the paper wrapper, the carbon fibers having an average length between about 0.125 inches and about 0.75 inches; and wrapping the paper wrapper around a column consisting essentially of a tobacco material.

15. A process as defined in claim 14, wherein the carbon fibers have an average length between about 0.125 inches to about 0.5 inches.

16. A process as defined in claim 14, wherein the carbon fibers have an average length between about 0.25 inches to about 0.35 inches.

17. A process as defined in claim 14, wherein the filler is present in the paper wrapper in an amount from about 20% by weight to about 40% by weight.

18. A process as defined in claim 14, wherein the paper wrapper has a basis weight from about 45 grams per square meter (gsm) to about 60 grams per square meter (gsm) and a permeability of from about 5 Coresta unites to about 2,000 Coresta units.

19. A process as defined in claim 14, further comprising the step of coating the paper wrapper with a burn control additive.

20. A process as defined in claim 14, wherein the paper wrapper has a permeability of from about 15 Coresta units to about 55 Coresta units.

* * * * *